United States Patent [19]

Caffrey

[11] Patent Number: 4,903,960

[45] Date of Patent: Feb. 27, 1990

[54] AUDIBLE BABY CONVEYANCE

[76] Inventor: Cearan C. Caffrey, 11 Vincent Dr., Monroe, Conn. 06468

[21] Appl. No.: 274,389

[22] Filed: Nov. 21, 1988

[51] Int. Cl.[4] ..... A47D 13/04

[52] U.S. Cl. ..... 272/70.3; 446/414

[58] Field of Search ..... 272/74, 93, 73; 280/289 D, 87.04 A; 446/409, 411, 414, 420, 422

[56] References Cited

U.S. PATENT DOCUMENTS

| | | | |
|---|---|---|---|
| 1,705,209 | 3/1929 | Ryan | 446/409 |
| 2,679,126 | 5/1954 | Doe et al. | 446/114 |
| 3,796,430 | 3/1974 | Sudo | 272/70.3 |
| 4,270,764 | 6/1981 | Yamada | 446/414 |

FOREIGN PATENT DOCUMENTS

| | | | |
|---|---|---|---|
| 0808431 | 7/1951 | Fed. Rep. of Germany | 446/414 |

*Primary Examiner*—Stephen R. Crow

*Attorney, Agent, or Firm*—Gerald E. Linden

[57] ABSTRACT

A baby walker is equipped with a device that produces a sound, such as musical tones, when it is moved about a floor surface. The walker may be moved in response to the urgings of a baby within the walker, or in response to the urgings of another person pulling the walker via a pull-cord detachably connected thereto. The device for producing sound may be a trail-along toy, such as a wheeled xylophone, or may be built into the wheel assemblies of the walker. A cord attaching the trail-along toy to the walker may be grasped by the infant and pulled, without any motion of the walker, to produce a sound. Each wheel of the conveyance is suitably fitted with a sounding device, which may produce a different sound for the turning of each wheel.

8 Claims, 1 Drawing Sheet

AUDIBLE BABY CONVEYANCE

TECHNICAL FIELD OF THE INVENTION

The invention relates to baby (infant) conveyances, such as walkers, strollers and carriages.

BACKGROUND OF THE INVENTION

Sit down, chair-type devices with wheels for rolling about a floor surface in response to walking-type foot movement by infants are known as "walkers". Typically, the walker is equipped with six wheels evenly-spaced about a lower support ring at the bottom of the walker, and the top is equipped with a tray surrounding the baby at about armpit level, or slightly lower. The wheels are pivotally mounted to the lower support ring in order that the walker can readily be propelled in any direction. A harness-type seat is suspended from the tray, or upper support member, and it is herein that the infant sits with feet extending through leg holes in the harness and touching the floor; arms extended generally over, and possibly hands holding onto, the tray. The general intent of such walkers is to allow the baby a degree of mobility, which seems to keep the infant entertained for a short period of time. The tray can also accomodate various toys for additional entertainment value, but these seem to soon be cast "overboard". A more specific intent of the walker is to train the baby in the walking motion, a skill which has been determined to be invaluable in later life.

Despite the various features described above, the walker fails to command much attention from the infant. Furthermore, other than the limited feedback provided by motion, it is rather uncertain whether the walker efficiently provides suitable feedback to encourage the walking activity for which it is intended.

It is therefore an object of this invention to provide a walker that is more "interesting" to the infant, thereby increasing its attention value to the infant.

It is a further object of this invention to provide a walker with more definite feedback in response to propulsion of the walker by the infant, thereby providing a greater psychological incentive for the infant to practice walking.

SUMMARY OF THE INVENTION

According to the invention a baby conveyance, such as a walker, is equipped with means for generating an audible sound, such as musical tones, in response to movement of the walker.

In an embodiment of the invention, the means for generating sound is a trail-behind apparatus, with wheels of its own and attached to the walker by a cord, or the like. The trail-behind apparatus may be a xylophone-type toy that produces a sequence of pleasing sounds in response to the turning of its wheels. In this embodiment of the invention, the cord may be attached to the walker within reach of the infant, who can then pull on the cord, for instance while the walker is stationary, to cause the production of sound.

In an alternate embodiment of the invention, at least one wheel assembly of the conveyance is equipped with means for generating a sound. All of the wheel assemblies may be equipped to produce sound when the conveyance is moving, and they may each produce a different sound to create a symphony of sound.

Other objects, features and advantages of the invention will become apparent in light of the following description thereof.

DETAILED DESCRIPTION OF THE INVENTION

Figure 1:
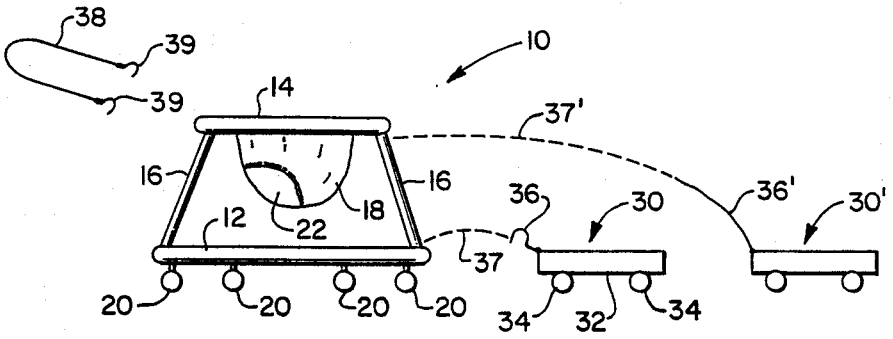
FIG. 1 is a side view of a baby walker according to this invention.

FIG. 1 shows a baby walker 10. The walker includes a lower support member 12, an upper support member 14, struts 16 supporting the upper support member above the lower support member, a harness-type seat 18 suspended from the upper support member and wheel assemblies 20 attached to the lower support member. The lower support member is basically a hoop. A plurality of, such as six, caster-type wheel assemblies 20 are attached at evenly-spaced positions about the hoop, in a manner that allows for pivoting (directional tracking) as well as rolling. The lower support member also serves as a bumper, limiting motion of the walker in any direction. The upper support member is basically a round tray with a hole in the middle thereof through which the baby is inserted to sit in the seat with its legs extending through leg openings 22 in the seat so that its feet can contact the floor. In this manner the baby can propel the walker in any direction by a walking movement of its legs when its feet contact the floor surface upon which the walker rests.

In one embodiment of the invention, a trail-along device 30 is adapted in use to be fitted to the walker 10. The device 30 has a body member 32 and wheels 34 supporting the body member for movement upon a floor surface. The device 30 is also provided with suitable means for releasably attaching to the walker, such as a hook 36 formed to engage the tubular lower frame member 12, as indicated by the dashed line 37. The device 30 is, for instance, a xylophone toy, shown only generally in FIG. 1, of the type wherein the wheels thereof turn a crankshaft-type axle that causes one of more hammers to contact metallic sounding elements (not shown). Thus, it is evident that movement of the walker will cause sounding of the device 30. Such a toy is typically equipped with a cord, shown as 36' in the device 30', which can be attached, such as by typing a knot, either to or through the upper support element 14, or to a support member 16, preferable adjacent the upper support member, as indicated by the dashed line 37'. In this "corded" embodiment of the invention, the baby is able to grasp the cord 36' and cause movement, and consequently sounding, of the device 30' without moving the walker 10. Conveniently, for another person, such as an adult to pull the walker around the baby aboard, a cord 38 is provided with a hook(s) 39 for attachment to, for instance the upper support member of the walker. The attachment of the cord 38 and/or the cord 36' is convenitently by a hook at the end of the cord that engages, for instance, a hole in the periphery of the tray 14.

In the embodiment shown in FIG. 1, it is evident that two or more trail behind devices 30 or 30' can be attached to the walker, either in parallel or in series.

Figure 2:
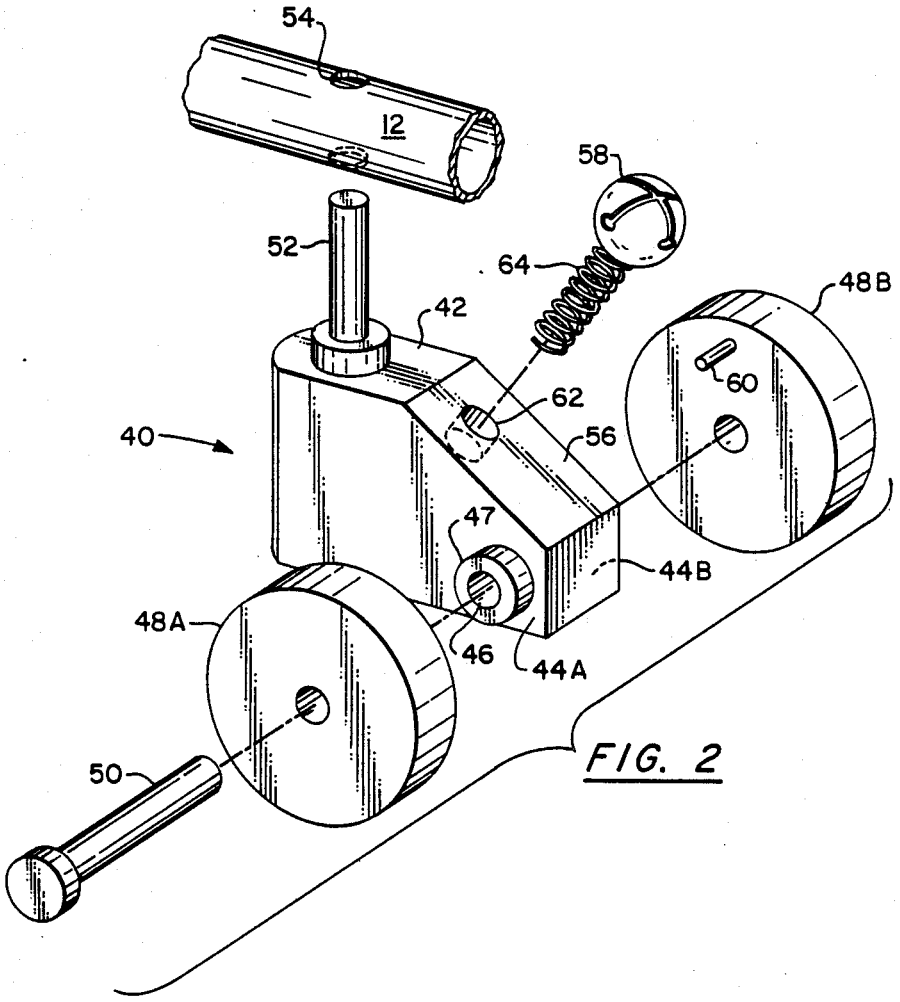
FIG. 2 is an exploded, detailed perspective view of a wheel assembly for a baby conveyance, such as the walker of FIG. 1.

FIG. 2 is an exploded, detail view of a wheel assembly 40 for a baby conveyance, such as for the wheel assembly 20 of the walker 10. The wheel assembly 40 includes a body member 42, which is largely a solid member having two parallel side surfaces 44A and 44B, a transverse hole 46 extending through the member from one side surface to the other. The wheel assembly 40 includes two wheels 48A and 48B which are mounted for rotation to the sides 44A and 44B of the truck 42, respectively, by an axle pin 50. Bosses 47 are provided about the hole 46 on both sides 44A and 44B of the body member 42 to space the wheels from the sides of the body member 42, but the bosses could as well be provided on the wheels themselves. A pivot pin 52 extends upward from the body member 42, and is suited to engage a hole 54 in the conveyance, such as in the lower support member 12 of the walker 10 (of FIG. 1) to allow the wheel assembly 40 to pivot with respect to the walker. Mounted to the body member, such as on an upper surface 56 thereof, is a sound-producing device 58, such as a bell. A cooperating portion of the sound producing device is suitably a pin 60 mounted to an inside surface (facing the body member 42) of the wheel 46B. In this manner, the pin 60 contacts the bell 158 when the wheel 46B rotates, without impeding the rotation thereof. According to an aspect of the invention, the sounding element (bell 58) is mounted, such as by snap-engagement, in a holel 62 in the body member 42 so that it can be removed therefrom when it is not desired that the walker generate a sound when it is moving. Furthermore, by having the sounding element 58 detachable from the body member 42, other sounding elements, besides the bell 58, can be substituted therefore. These would include whistling devices, squeaking devices, buzzing devices and the like. The pin 60 could be modified accordingly to activate the sounding device 58. The bell 58 is shown having a stalk 64, which is preferably a tightly wound spring, which is insertable into the hole 62 to releasably assemble the bell to the body member 42, while allowing it to deflect when the pin 60 comes around and hits the bell 58. The wheel 46B can be equipped with more than one pin to increase the ringing of the bell, or the other wheel 46A can also have a pin, to effect the same purpose.

According to a feature of the invention, at least one wheel assembly 40 of the conveyance is equipped with means for generating a sound, or noise, when the walker is moved, thereby obviating the need for a trail-along device 30 or 30'. Furthermore, each of the different wheels assemblies 40 of the walker may be equipped with a bell of a different tone, or with a different sounding device, so that when the walker is moved about, a symphony or cacaphony, respectively, of sound is produced to the joy and amazement of the baby.

In the embodiment of the invention illustrated in FIG. 2, it is evident that a wheel assembly including only one wheel can be fitted with the sound producing apparatus (e.g., 58 and 60).

It is also evident that the sound producing devices discussed herein, with respect to either embodiment, can be supplied as a kit for retrofitting to a conveyance, and, in the case of the walker, the pull cord 38 can be supplied with the kit.

One skilled in the art to which this invention pertains will recognize that a variety of toys and/or devices could be substituted for the trail-behind toy 30 or 30' shown in FIG. 2, and need not have wheels of their own. Rather they could be devices that produce sound in connection with tumbling about in contact with the floor surface.

I claim:

1. A baby walker comprising:

a lower support member;

an upper support member;

struts supporting the upper support member above the lower support member;

seat means, suspended below the upper support member, for seating a baby with its feet extending through leg holes in the seat means and touching a floor surface;

a plurality of wheel assemblies attached to the lower support member for supporting the baby walker for movement about the floor surface, at least one of the wheel assemblies having a self-contained sound producing means in response to movement of the baby walker about the floor surface, each of the at least one wheel assemblies comprising:

a body member having two parallel side surfaces and a transverse hole extending through the body member from one side surface to the other side surface;

an axle pin having two ends and extending through the transverse hole through the body member, the two ends of the axle pin extending beyond the body member; and two wheels, each wheel mounted to an end of the axle pin on a respective side of the body member for rotation with respect to the body member;

said sound producing means comprises:

a bell means mounted to the body member; and a striking pin mounted to an inside surface of at least one of the wheels for contacting the bell means when the wheel rotates with respect to the body member, wherein said bell means is a bell having a stalk which is inserted into a mounting hole in the body member.

2. A baby walker according to claim 1, further comprising:

two bosses, each boss disposed about the transverse hole through the body member on one side surface thereof and spacing the wheels from the respective side surface of the body member.

3. A baby walker according to claim 1, further comprising:

two bosses, each boss disposed on an inside surface of one of the two wheels and spacing the wheels from the respective side surfaces of the body member.

4. A baby walker according to claim 1, further comprising:

means for pivotally attaching the body member to the lower support member, including:

a hole in the lower support member; and a pivot pin extending upwardly from the body member and pivotally engaging the hole in the lower support member.

5. A baby walker according to claim 1, wherein the sounding element is removably mounted to the body member.

6. A baby walker according to claim 1 wherein the sounding element is mounted to an upper surface of the body member.

7. A baby walker according to claim 1, wherein the stalk is a tightly wound spring allowing the bell to deflect when contacted by the striking pin.

8. A baby walker according to claim 1 wherein a plurality of wheel assemblies have said sound producing means, each said sound producing means produces a distinct sound.

* * * * *